US005080236A

United States Patent [19]

Conner

[11] Patent Number: 5,080,236

[45] Date of Patent: Jan. 14, 1992

[54] PRINTER SLED

[76] Inventor: Walter C. Conner, 3045 Henrietta Ave., La Crasenta, Calif. 91214

[21] Appl. No.: 605,935

[22] Filed: Oct. 30, 1990

[51] Int. Cl.[5] ..... A47F 5/00

[52] U.S. Cl. ..... 211/13; 211/151; 211/50; 400/613.2

[58] Field of Search ..... 211/151, 13, 50, 162; 400/613, 613.2, 617; 248/676, 918, 924

[56] References Cited

U.S. PATENT DOCUMENTS

| | | | |
|---|---|---|---|
| 3,465,894 | 9/1969 | Setecka | 211/151 X |
| 4,227,466 | 10/1980 | Rooklyn | 211/151 X |
| 4,482,066 | 11/1984 | Dykstra | 211/151 |
| 4,515,490 | 5/1985 | Marker | 400/613.2 |
| 4,717,273 | 1/1988 | Elderfield | 400/613.2 |
| 4,938,447 | 7/1990 | Schriner | 211/13 X |

*Primary Examiner*—Robert W. Gibson, Jr.

*Attorney, Agent, or Firm*—Frank L. Zugelter

[57] ABSTRACT

A printer sled (20) comprising a platform (42) for computer printer (22), the platform (42) mounted on a frame members (44) to which freely-rotating grooved wheels (47) are mounted and which engage corresponding tracks (39, 40) mounted atop a framework or cabinet (21) and extending in the same direction as the movement for the sled (20). A manually-operable tab (57) in a frame member (44) provides release of its stop member (60) from frictional engagement with one of the tracks (39, 40) in order to slide sled (20) to any point across the width of the frame work (21). Thus, the printer (22) can be disposed over any one of different-sized paper stacks 928) from which its paper is fed into the printer (22). Catching means (66 or 85) for catching printed paper are included with sled (20) and can be mounted thereto at the front or rear of the framework (21).

20 Claims, 4 Drawing Sheets 3
31
30
21
40
32
39
25
26
38
37
35
27
25
3

40
31
41
41
34
39
32
25
30
34
33
28e
21
29
26
36
37
35
28b
29
27
25

37
35

37

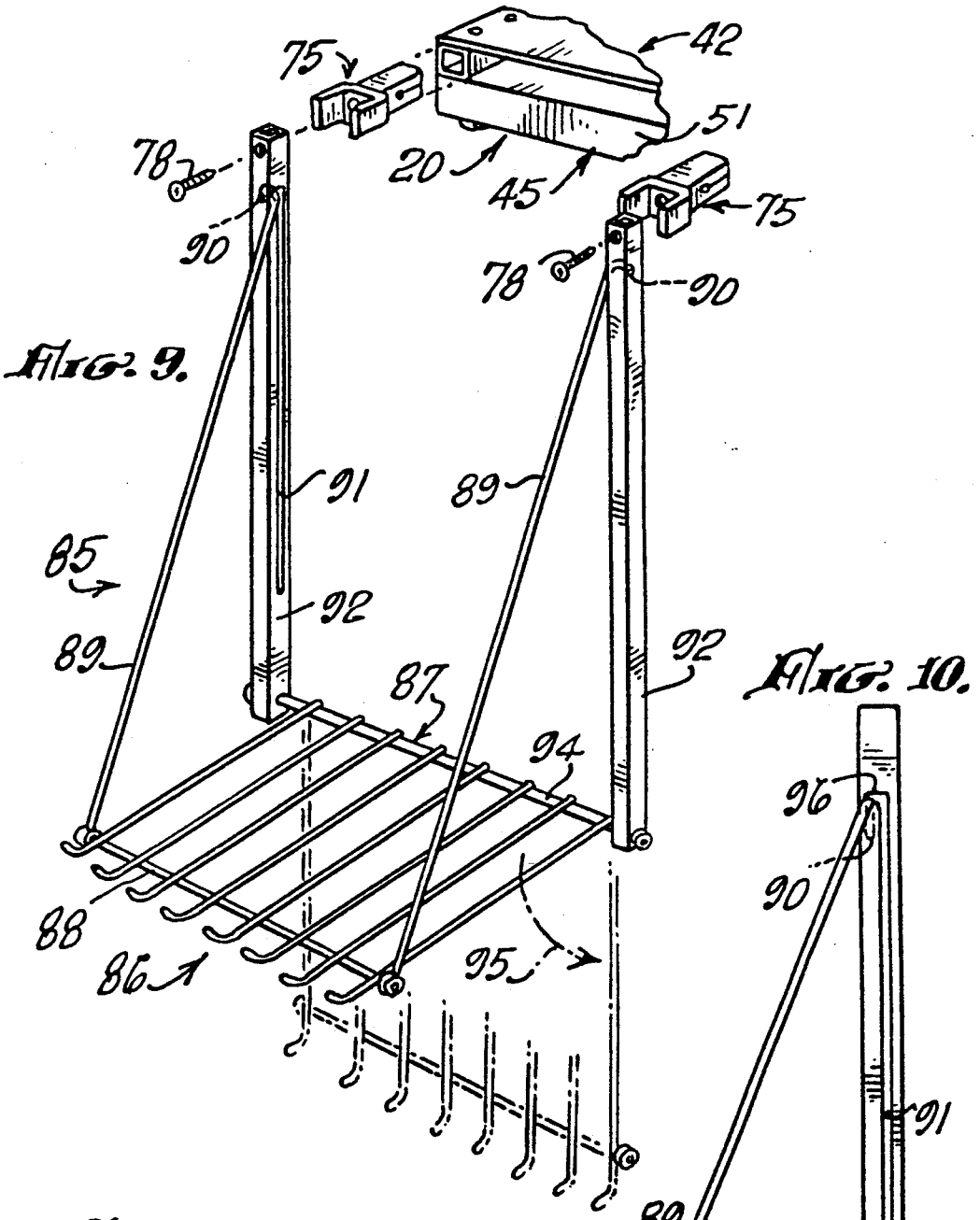
FIG. 9.
FIG. 10.
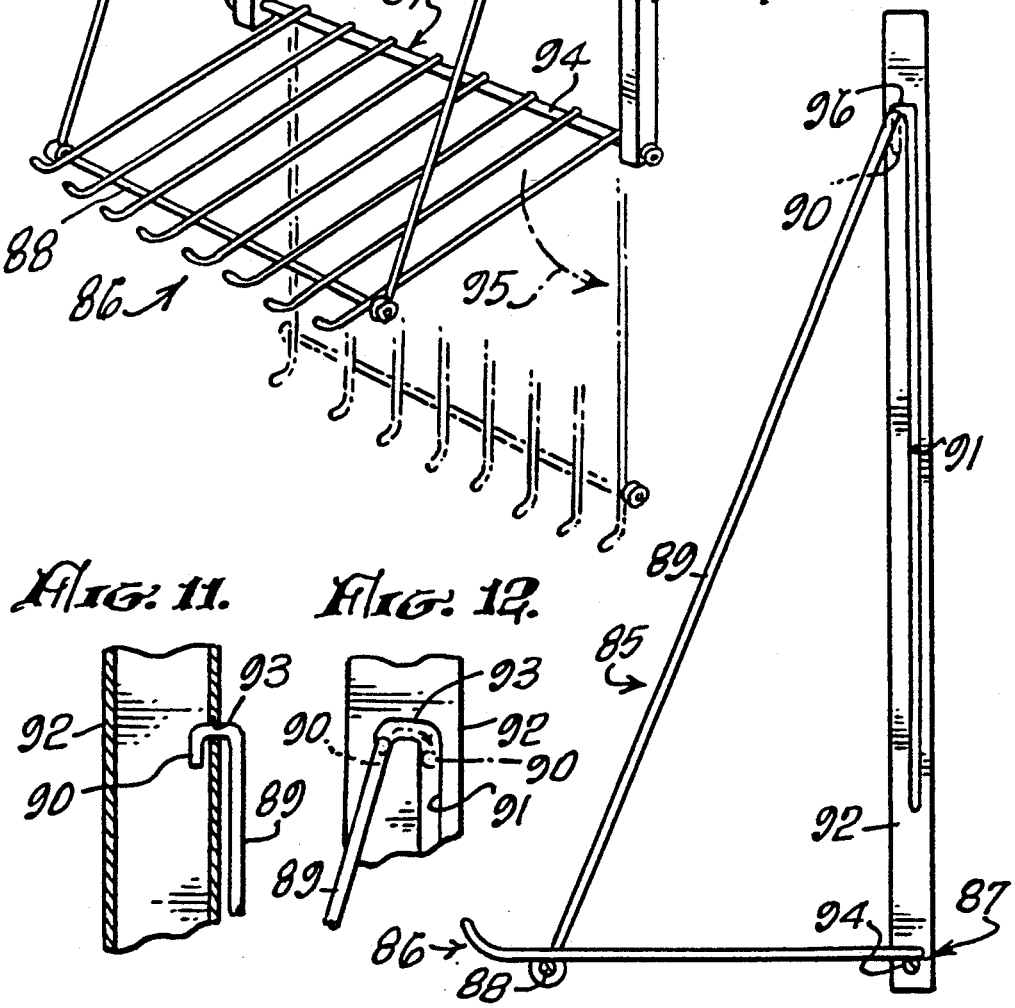
FIG. 11.
FIG. 12.

PRINTER SLED

TECHNICAL FIELD

This invention is directed to computer printers and their stands, and particularly to an apparatus by which a printer slides back and forth laterally in order to accommodate different-sized stationarily positioned paper stock to be fed through the printer.

BACKGROUND

Prior art teachings which disclose printer stands, sliding mechanisms, and apparata similar thereto are U.S. Pat. Nos.: 2,219,762; 2,220,475; 2,306,209; 2,932,541; 2,962,336; 4,226,410; 4,488,829; 4,515,490; and 4,626,048.

The prior art does not teach or suggest the concept of a laterally-moving printer for positioning over different-sized paper stacks arranged across the lateral extent of movement for the printer, such arrangement not being necessarily limited to but one shelving for positioning such paper stacks.

DISCLOSURE OF THE INVENTION

The invention comprises a sled on which a computer printer is to be mounted, the sled capable of sliding on tracks throughout a lateral paper stack supporting arrangement or framework, such as a cabinet, which accommodates different sizes of paper stacks, printing stock, or continuous recording webs of paper which are to be fed into the printer. The sled provides the ability for the printer mounted thereon to sit directly over any one of a plurality of such paper stacks of different sizes and which may or may not still be in their packaged boxes or cartons.

Summarily, the sled comprises a platform for seating a printer, the platform being mounted on a frame which slides on or rolls along tracks secured to a paper stack supporting means, such as a framework which includes shelving on which different sized paper stacks are stationarily positioned. The tracks traverse the lateral extent of such framework above the paper stacks therein, in order for the sled to be positioned over any one of the paper stacks disposed across the lateral arrangement. A brake is provided to maintain the sled at any stationary position along its tracks, it readily being released from its engagement with the tracks or track by simple manual pressure on it, so that the sled can be displaced to another station on the tracks and over a different sized paper stack.

Means are provided to catch refoldable printout sheets of a paper stack as its web is ejected from the printer, such means adaptable for attachment to the front or rear of the sled depending on the type of printer (bottom or front feed) being used. A collapsible embodiment of the catching means also is illustrated, so that an easier access is gained when loading the paper stack onto rear-feed printers.

An object of this invention is to provide a novel sliding apparatus by which a printer is transported to over any one of a number of different sized paper stacks.

Another object of the invention is to eliminate labor and its consuming time for placing different-sized paper stacks under a printer on an ordinary printer stand.

A further object of this invention is to save time in relating a printer to a particular sized web of paper for feeding therethrough.

A still further object of this invention is to transport a printer to its printer form or forms rather than transporting the form or forms to the printer (usually setting on a printer stand).

Another object of the invention is to provide flexibility in the sizes of stacked paper that are to be processed through the printer.

A further object of the invention is the freeing-up of floor and storage space that otherwise is required for stacked paper awaiting application to the printer.

These and other objects and advantages will become more apparent by a full and complete reading of the following description, the appended claims thereto, and the accompanying drawing comprising four (4) sheets of twelve (12) FIGURES.

BRIEF DESCRIPTION OF THE DRAWING

FIG. 1 is a perspective view of an installation of the invention, showing it in terms of a printer seated on its sled that is mounted upon a framework, such as a cabinet or the like.

FIG. 9 is a perspective view of an alternate embodiment of a catching rack used in combination with the printer sled.

FIG. 10 is a side elevational view of the catching rack of FIG. 9.

FIGS. 11 and 12 are enlarged fragmentary cutaway views of portions of the catching rack illustrated in FIGS. 9 and 10, taken at right angles to each other.

BEST MODE FOR CARRYING OUT THE INVENTION

Figure 1:
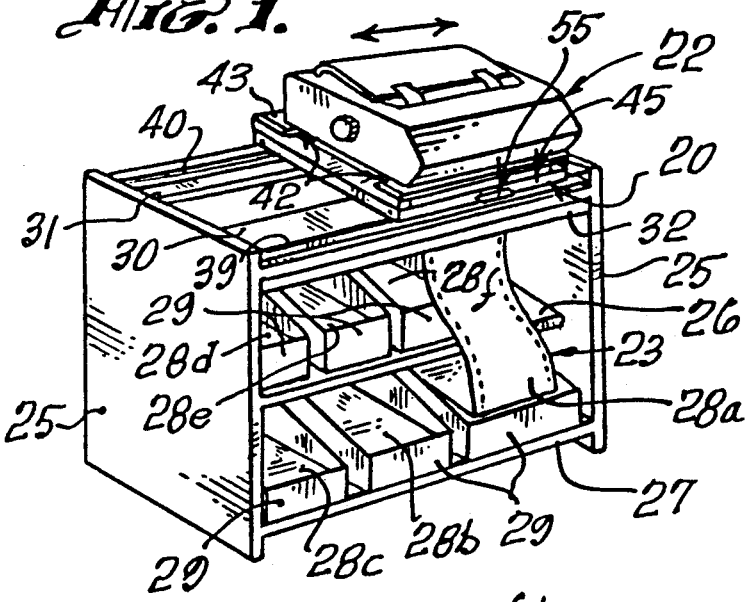

Looking now to the drawing in which reference characters therein correspond to like characters enumerated hereinafter, FIG. 1 illustrates an installation of a sled 20 upon a framework, such as a cabinet 21, FIG. 2, and on which sled a printer 22 seats. Printer 22 is usually, though not exclusively, the kind associated and operatively connected with a computer in which printing commands are generated so that its operatively connected printer executes the commands to print out on paper 23, the characters which have been processed through the computer (not shown).

Figure 2:
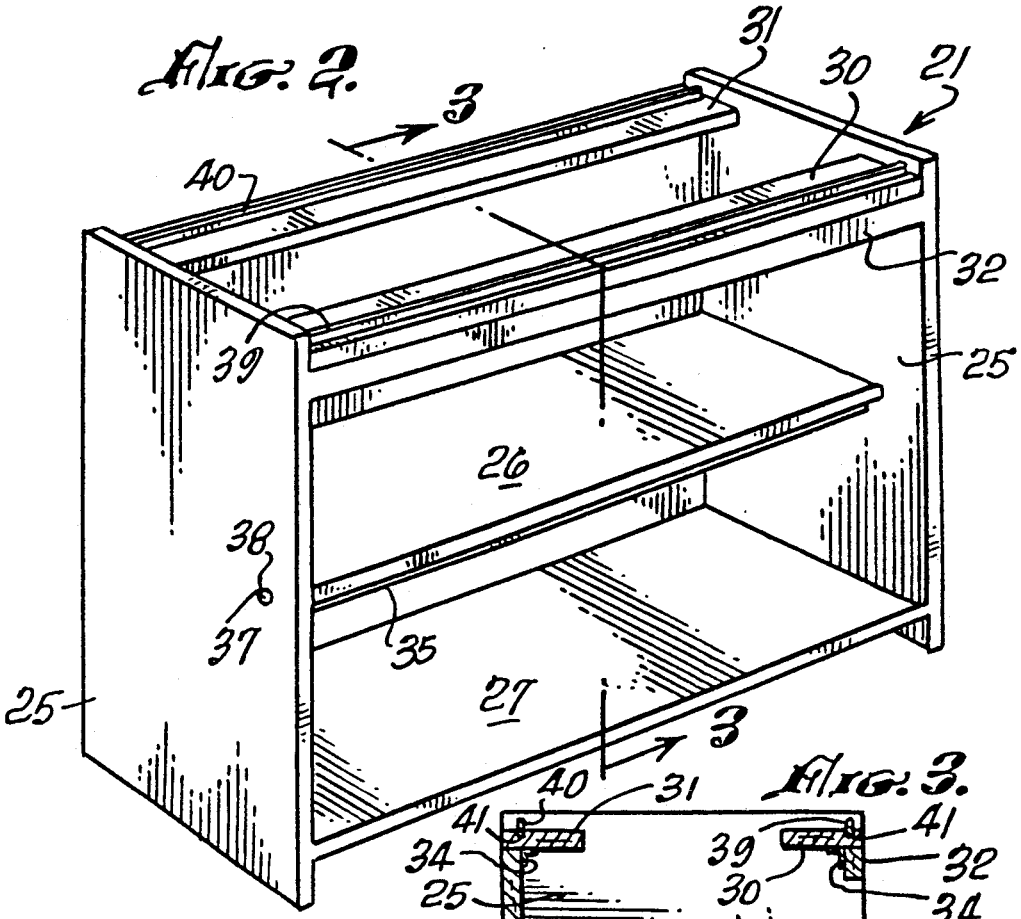
FIG. 2 is a perspective view of a cabinet adapted to the utilization of the invention.

Cabinet 21, FIGS. 1, 2, comprises a pair of spaced uprights 25 which suitably support shelving, here in the form of a plurality of shelves 26, 27, etc., sandwiched in horizontal fashion between them. Mounted along the length of each of the plurality of shelves 26, 27, etc., are one or more stacks 28*a*–28*f* of printer paper 23. Each of these stacks 28*a*–28*f* of paper is of a different size, and is usually retained within, though not necessarily, its own shipping carton or box 29 that is tailored to the particular size of the paper contained therein. Each of cartons 29, with paper stack usually in the form of a continuous recording and foldable web, has been opened prior to inserting it in its place in cabinet 21, and is usually cutaway along its sides and top to expose its particularly-sized printer paper stack 28*a*, . . . , 28*f*, . . . . Each opened and cutaway box 29 with its paper 23 is introduced into a desired position onto the shelving; here, on the length of its shelf of cabinet 21, and thereafter its paper is ready to be fed into a printer 22 seated on its sled mounted atop cabinet 21 (or other suitable framework) when the printer 22 is disposed directly over such one of such stacks.

Figure 3:
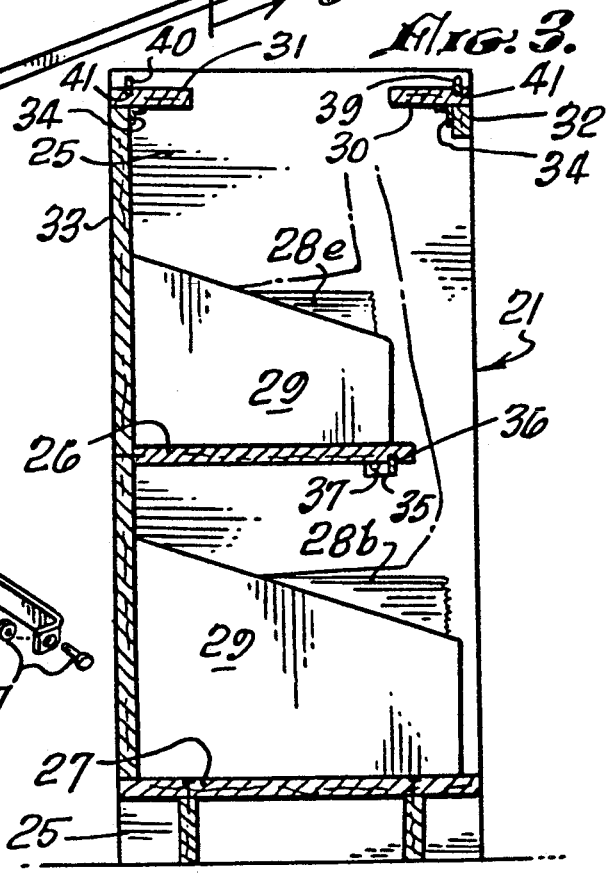
FIG. 3 is a view taken along line 3—3 of FIG. 2.
Figures 5, 6:
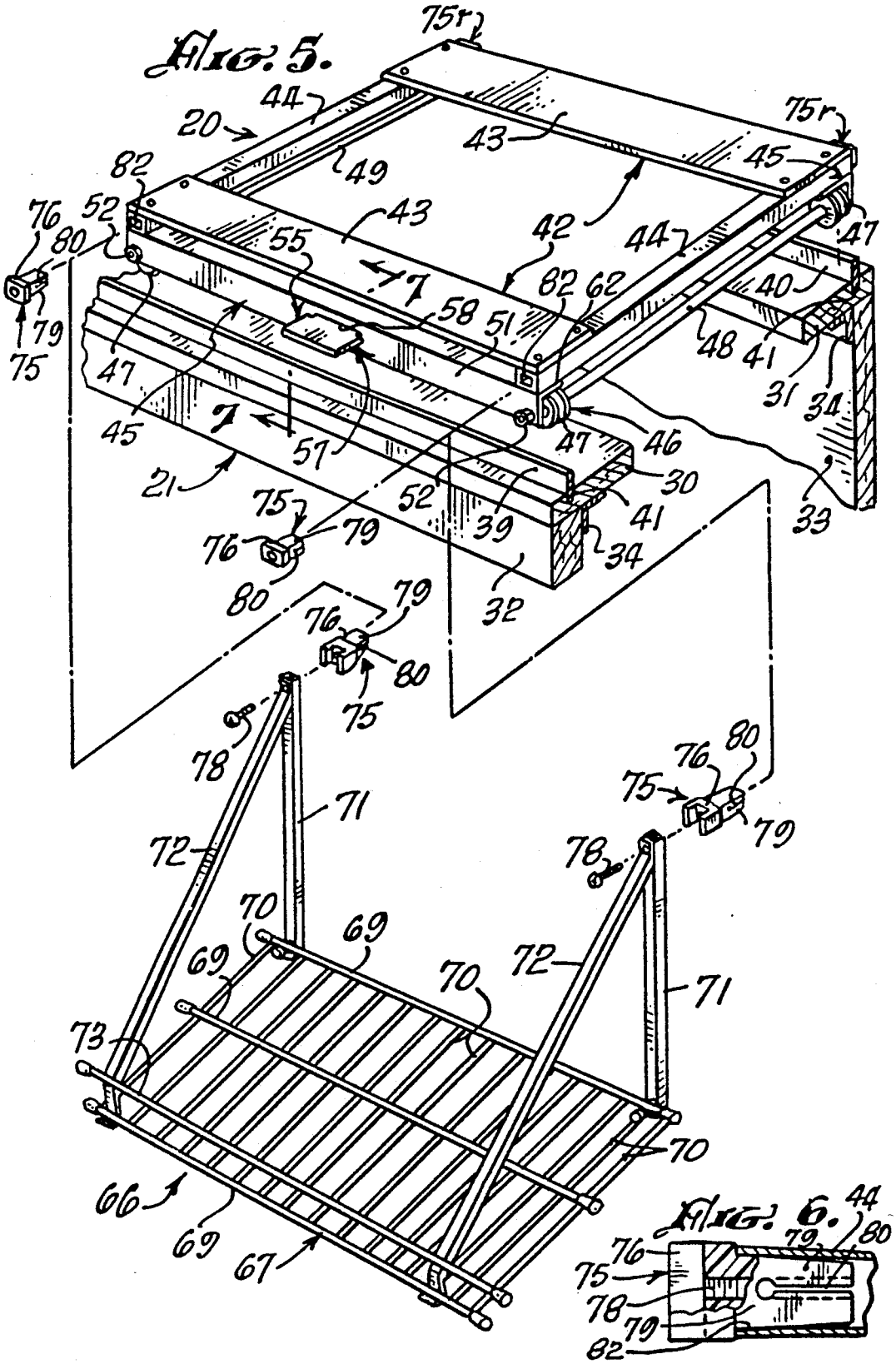
FIG. 5 is an exploded perspective view of the subject matter of the invention.
FIG. 6 is a fragmentary view, partly cutaway, of an adaptor plug which mounts paper catching means to the sled.

At the top of cabinet 21, FIGS. 2, 3, 5, laterally-extending and spaced, flat support members 30, 31 are disposed between uprights 25. Member 30 mounts upon a rib 32 laterally extending between uprights 25 at the front of the cabinet, while member 31 mounts upon the cabinet's rear wall panel 33. Laterally-extending flanges 34 secure their corresponding members 30, 31 to rib 32 and panel 33, respectively, in known fashion. Rib 32 and wall panel 33 further are suitably fastened in known manner to such flanges 34, thus providing for a stable cabinet, or framework, formed of these or other elements which likewise are fastened together in known fashion to produce a suitable framework used in conjunction with sled 20.

Figure 4:
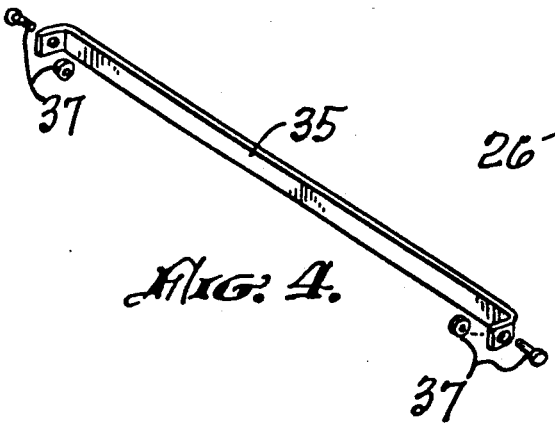
FIG. 4 is a perspective exploded view of an element which prevents sagging of shelving weighted down by a stack or stacks of paper.

A re-enforcing bar 35, FIG. 4, for each shelf 26, 27 is mounted to its underside via a groove 36 and fastened by a fastening means 37 at 38, FIGS. 1, 4, in each upright 25, so that deformation of the shelving under the weight of boxes and their paper stacks is prevented, and thereby provide an efficient feeding correlation to its printer.

A track 39 and a track 40 are suitably mounted on and throughout the length of such framework; here, on flat members 30, 31, respectively, generally in spaced and parallel fashion to one another. A groove 41 is provided in each of flat members 30, 31 so that a press fit of tracks 39, 40 thereto retains them in place. It is the printer sled 20 which is slidably mounted to and along these tracks 39, 40.

Looking to FIG. 5 in particular, printer sled 20 comprises a platform 42 for printer 22, such platform illustrated here as being a pair of spaced slats 43 suitably secured to a pair of transversely-extending tubular frame members 44. Tubular frame members 44 themselves are mounted on and suitably secured, as by welding, to flanged members 45 which extend in the same general lateral direction as slats 43. A sliding means 46 is provided for sled 20 and in turn is mounted to flanged members 45, and, by way of illustration not to be considered limiting, comprises grooved wheels 47 rotatably mounted on a pair of rods 48, 49 each of which being secured to the vertically depending leg 51 on each flanged member 45 by means of a nut 52 threaded onto the end of its corresponding rod 48, 49 which has passed through a hole (not shown) in leg 51. A pair of grooved wheels 47 mount on corresponding ends of rods 48, 49 so that they ride on the one track 39, while another two grooved wheels 47 mount on the other corresponding ends of rods 48, 49 to engage their track 40 along which they roll; so that sled 20 can slide to-and-fro along tracks 39, 40.

Figure 7:
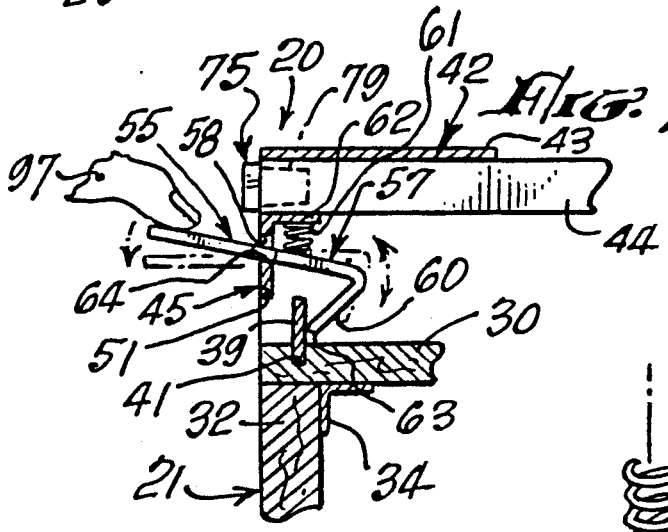
FIG. 7 is a view taken along line 7—7 of FIG. 5.
Figure 8:
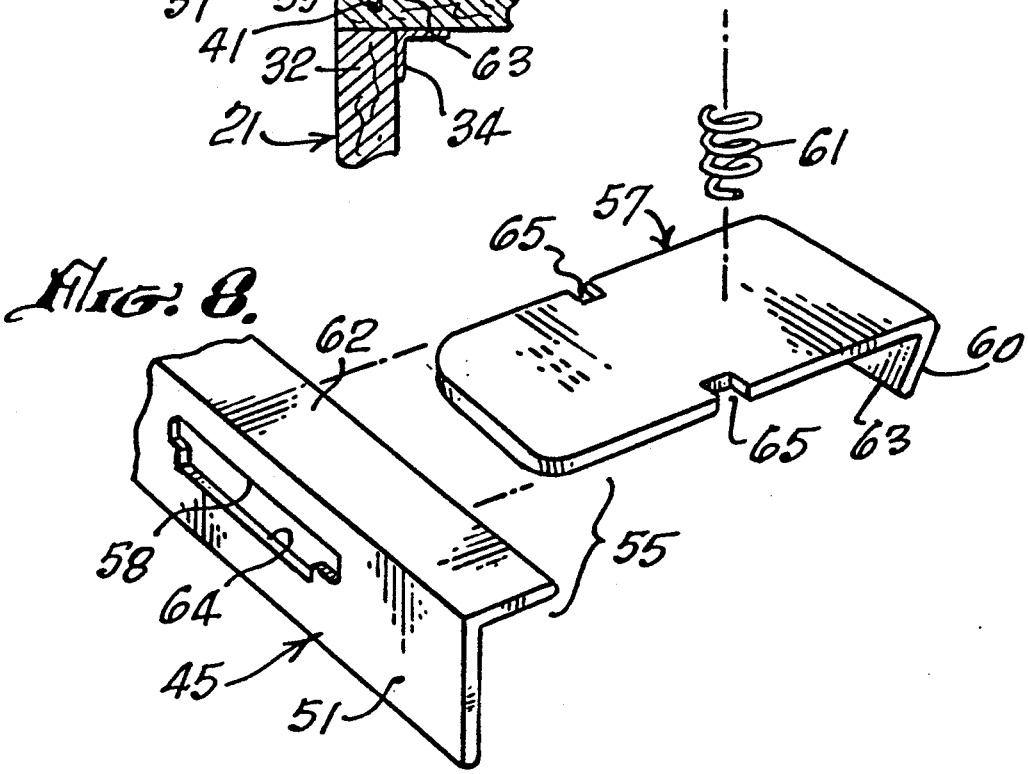
FIG. 8 is an exploded perspective view of the braking mechanism illustrated in FIG. 7.

A braking means 55, FIGS. 5, 7, 8, for stationarily positioning sled 20 at any point along tracks 39, 40 is provided. Braking means 55 comprises an operable finger member or tab 57 mounted in a slot 58 formed in the vertically depending leg 51 of the flanged member 45 at the front of cabinet 21, having its forward portion projecting outwardly of leg 51 and its other or rearward portion including a stop member 60 that frictionally engages the inside wall of the one track member 39 (FIG. 7). To maintain such frictional engagement, a coiled spring 61 seats atop tab 57 while being compressed between it and the horizontally-extending leg 62 of the frontal flanged member 45. The force of compressed spring 61 maintains stop member 60 in a downwardly locating position, and in which position its tip 63 abuts against the inner wall of track 39 (FIG. 7).

Slot 58, FIG. 8, is so formed in leg 51 as to include a pendant recess 64 smaller in width than its remaining portion, so that a necked-downed portion 65 in tab 57 seats in such recess 64, thereby preventing displacement of tab 57 from slot 58 while also providing a fulcrum for the pivoting of tab 57. Coiled spring 61 in its action retains member 57 in recess 64, while the remaining wider portion of slot 58 is provided to easily remove or install the member 57.

Means 66, FIG. 5, for catching printed paper that has passed through printer 22 is provided. Means 66 comprises a basket 67 adaptable for mounting to sled 20 at either its frontal or rearward locations. FIGS. 5 and 6 illustrate a catching means 66 located frontally of cabinet 21 and comprises a basket 67 secured to sled 20 in order to catch printed paper regardless of whatever stack position printer 22 may be in, in relation to the plurality of paper stacks in cabinet 21. Basket 67 comprises a plurality of horizontally-disposed spaced rungs 69 as its floor, held together by a series of cross-rungs 70 spot-welded thereto, a pair of spaced vertically-disposed standards 71 and transversely-disposed standards 72 extending from the top of standards 71 in a downward and outward direction for attachment to an elevated rung 73 and a rung 69 disposed below rung 73. The elevated rung 73, FIG. 5, assists in retaining the initial printed paper from printer 22 as it is caught by and collects in basket 67. It should be apparent that catching means 66 (as well as the alternate one described below) is not limited in its use to catch refoldable paper webs, but rolls of paper as well.

A fastening means 75 is provided to attach basket 67 to sled 20, and comprises an adapter plug 76 insertable into the corresponding ends of the tubular frame members 44 and screws 78 which attach standards 71 to their corresponding plugs 76. Plugs 76 are of the press-fit type, FIG. 6, whereby each of their trunks 79, made of rubber or similar pliable material, includes a slot 80 by which it is compressed as it is inserted into its open corresponding end 82 of tubular members 44, after which such trunk 79 frictionally engages the walls of such tubular member 44 to retain its plug 76 therein. Thus, as sled 20 slides along its tracks 39, 40, catch means 66 travels with it.

Catching means 66 also is readily attached to sled 20 at the rear of its printer 22 should the paper feed to printer 22 be such as to flow rearwardly of the printer rather than frontally therefrom and as illustrated. See FIG. 5 for the fastening means 75, to which a basket 67 of catching means 66 is readily attachable in the same manner as described above and as illustrated in FIGS. 5, 6.

FIGS. 9–12 illustrate an alternate catching means 85, comprising a collapsible basket 86. Collapsible basket 86 comprises a conventional rung-formed floor 87 supported generally in a horizontal inclination by means of a stringer 88, the ends of stringer 88 being attached to corresponding posts 89. The opposite ends of the posts 89 are hooked as at 90, FIGS. 11, 12, such hooks 90 being inserted into suitably-provided slots 91 on the inside walls of their corresponding vertically extending standards 92 (similar to standards 71) and thence seated in bayonet-slot catches 93 at the top of slots 91. An inner stringer 94, FIG. 9, is pivotally mounted to standards 92 and to which the rungs of floor 87 are suitably secured. In the event that floor 87 is desired to be collapsed or slipped downwardly as shown by arrow 95 in FIG. 9, hooks 90 are withdrawn from their bayonet-slot catches 93 to ingress into their corresponding slots 91 which communicate with bayonet-slot catches 93, and thereafter slid downwardly through their corresponding slots 91 of members 92. Stringer 88 descends and floor 87 drops, as seen in phantom in FIG. 9. This collapsible means makes for easier access for loading paper stacks, forms, etc., on rear feed printers.

In operation, with or without a printer 22 seated on its platform 42, grooved wheels 47 engage their corresponding tracks 39, 40, and tip 63 frictionally engages the inner wall of track 39. Thus, the sled is stationarily positioned. A finger 97 (FIG. 7) depresses tab 57 so that its tip 63 is withdrawn from contact with track 39. The sled 20 is no longer frictionally engaging track 39 and now is readily slidable along tracks 39, 40 to be positioned at any point along such tracks, but more particularly over any one of the plurality of stacks 28*a*–28*f* of paper disposed at any point along shelving on which such stacks set. Taking FIG. 1 as an example, the end of the paper web of paper stack 28*a* is readily raised from its box 29 to be inserted into and fed up through the bottom of printer 22, for further correlation to the printer (not shown) and which is not part of this invention. The printer ejects the printed paper web from stack 28*a* as it is fed through the printer in accordance with commands from the computer (not shown). As the printed paper egresses from the printer, it is directed into catching means 66, 85, as the case may be, and there re-stacked or retained, awaiting further processing.

When it is decided to use a different sized printer paper, and paper from stack 28*a* has been removed from printer 22, and it is necessary to move to another point in the width of the framework or cabinet 21 or shelving, the operator's finger 97 depresses tab 57 to release brake 55 from track 39. The operator then slides or rolls printer and sled to an alternative position or location on tracks 39, 40 so that the paper web of a different stack of paper, such as paper in stack 28*c*, can be fed into the computer printer to be disposed directly over it. After reaching the position of printer and sled over stack 28*c*, the operator releases member 57 to thereby cause braking means 55 to again frictionally engage track 39 and thereby again stationarily position sled and printer.

Assembly of the apparatus is accomplished by first securing tubular members 44 and flanged members 45 together, after which platform 42, here in the form of slats 43, is suitably secured to members 44. Braking means 55 is installed, either first upon leg 51 with its slot 58, or after flanged member 45 has been assembled to a tubular member 44, or even after sled 20 itself is mounted to tracks 39, 40. Tab 57 is inserted through slot 58 so that neck-down portion 65 engages recess 64, and thereafter, coiled spring 61 inserted between the rearward portion of tab 57 and the leg 62 of flanged member 45. Rollers 47 are mounted to their rods 48, 49, after which the rods are mounted and secured to legs 51 of flanged members 45 by means of nuts 52. Adapter plugs 75 are inserted into the open ends of tubular members 44, after which screws 78 are passed through standards 71 or 92, as the case may be, and threaded to their plugs 75, thereby easily mounting, to either the front or the rear of the framework or cabinet 21, the corresponding catching means 66, 85 to sled 20.

Suitable materials are available for the various elements described above and which heretofore are known for the materials used in such described elements. The tubular members, tracks, and flanged members may be of aluminum or other metal. The rods, grooved wheels and nuts are formed of suitable metal or plastic materials. The plugs are formed of suitable rubber or plastic pliable materials. The platform may be of plywood, aluminum or other suitable lightweight material.

Various modifications and changes may be made within the concept of the invention and within the scope of the letter and spirit of the appended claims hereto. For example, the mounting of tracks 39, 40 to a stable framework is only necessary in relation to shelving on which the paper stacks are stationarily positioned. Thus, cabinet 21 is but an example of such a stable framework which includes at least the combination of tracks 39, 40 fixed in relation to such shelving, such as shelves 26, 27 etc. . . . , so that the paper webs of the different sized paper stacks can be readily available for manipulation into the printer disposed above anyone of them on the tracks. Further, the mounting of braking means 55 is not limited to the front of cabinet 21, but also may be mounted to the flanged member 45 at the rear of cabinet 21 or the frame to which such flanged member is mounted. Elements other than grooved wheels 47 may be used to function as the means by which tracks engage sled and sled moves therealong. Further it is understood that the stacked paper or paper stacks described herein as of a continuous web nature, need not include creases by which the continuous web is folded, and the catching means remains operable in application of the invention. And the described framework containing the tracks 39, 40 is adaptable for fixation to an already existing cabinet, compartment or the like, by ordinary carpentry and woodworking skills.

I claim:

1. A sled adapted to position a printer or the like over any one of a plurality of stationary paper stacks extending in the direction in which the sled moves, comprising
   - a frame,
   - means for moving said sled along such direction mounted on said frame,
   - means for seating the printer or the like mounted on said frame, and
   - means for braking said sled at any point along the direction in which it moves mounted on said frame.

2. The sled of claim 1 wherein said moving means comprises rotatable grooved wheels.

3. The sled of claim 1 wherein said braking means comprises a biased yet pivotable means for stopping said sled at such point.

4. The sled of claim 3 wherein said stopping means comprises
   - a tab having forward and rearward portions, the forward of said portions projecting outwardly of said frame for manual manipulation,
   - a biasing spring mounted between the rearward of said portions and said frame,
   - a stop member mounted on said rearward portion adapted to engage a track means to which said sled is adapted to be mounted.

5. The sled of claim 1 including means for catching paper.

6. The sled of claim 5 wherein said catching means comprises a basket, said basket mounted to said frame.

7. The sled of claim 6 wherein said basket comprises a pair of spaced standards each of which is connected to said frame, a floor connected to said standards, and stringers connecting said floor to said standards.

8. The sled of claim 7 wherein said floor is pivotally connected to said standards, said standards including bayonet catches communicating with slots in said standards, said stringers including hooks which releasably engage such catches and slidable in said slots to thereby collapse said floor by pivoting it downwardly.

9. An assembled combination including a slidable sled means which positions itself over one of a plurality of stationary paper stacks extending in the direction in which the sled means slides, and comprising a platform in said sled means for seating a printer or the like thereon, means for sliding said sled means in such direction, and means in the combination for frictionally engaging said sliding means as said sled means slides in said direction, and means mounted on said sled means for braking it against said engaging means.

10. The combination of claim 9 including means fastened to said sled means for catching paper.

11. The combination of claim 9 wherein said sliding means comprises freely rotatable grooved wheels mounted on said sled means and being operatively connected to said engaging means.

12. The combination of claim 10 wherein said sliding means comprises freely rotatable grooved wheels mounted on said sled means and being operatively connected to said engaging means.

13. The combination of claim 15 wherein said sled means includes a frame, said braking means mounted on said frame.

14. The combination of claim 10 wherein said sled means includes a frame, said braking means mounted on said frame.

15. The combination of claim 13 wherein said braking means comprises a biased yet pivotable means for stopping said sled means.

16. The combination of claim 14 wherein said braking means comprises a biased yet pivotable means for stopping said sled means.

17. The combination of claim 15 wherein said stopping means comprises a tab having forward and rearward portions, the forward of said portions projecting outwardly of said frame for manual manipulation, a biasing spring mounted between the rearward of said portions and said frame, a stop member mounted on said rearward portion adapted to frictionally engage said engaging means.

18. The combination of claim 16 wherein said stopping means comprises a tab having forward and rearward portions, the forward of said portions projecting outwardly of said frame for manual manipulation, a biasing spring mounted between the rearward of said portions and said frame, a stop member mounted on said rearward portion adapted to frictionally engage said engaging means.

19. The combination of claim 12 including a framework, said engaging means mounted on said framework and comprising a pair of spaced tracks, said sliding means operatively connected to said tracks.

20. The combination of claim 11 including a framework, said engaging means mounted on said framework and comprising a pair of spaced tracks, said sliding means operatively connected to said tracks.

* * * * *

UNITED STATES PATENT AND TRADEMARK OFFICE

CERTIFICATE OF CORRECTION

PATENT NO. : 5,080,236

DATED : January 14, 1992

INVENTOR(S) : Walter C. Conner

It is certified that error appears in the above-identified patent and that said Letters Patent is hereby corrected as shown below:

In line 44 of column 7, "15" should be read as -- 9 -- .

Signed and Sealed this

Eighth Day of June, 1993

*Attest:*

Michael K. Kirk

MICHAEL K. KIRK

*Attesting Officer*

*Acting Commissioner of Patents and Trademarks*